US010013863B2

(12) United States Patent
Sekiyama

(10) Patent No.: US 10,013,863 B2
(45) Date of Patent: Jul. 3, 2018

(54) RADIO APPARATUS

(71) Applicant: ICOM INCORPORATED, Hirano-ku, Osaka (JP)

(72) Inventor: Yoshio Sekiyama, Osaka (JP)

(73) Assignee: ICOM INCORPORATED, Osaka (JP)

( * ) Notice: Subject to any disclaimer, the term of this patent is extended or adjusted under 35 U.S.C. 154(b) by 0 days.

(21) Appl. No.: 15/449,091

(22) Filed: Mar. 3, 2017

(65) Prior Publication Data

US 2018/0005504 A1 Jan. 4, 2018

(30) Foreign Application Priority Data

Jun. 29, 2016 (JP) ..... 2016-128954

(51) Int. Cl.

| | |
|---|---|
| ***G08B 1/08*** | (2006.01) |
| ***G08B 21/08*** | (2006.01) |
| ***G08B 21/04*** | (2006.01) |
| ***G08B 29/18*** | (2006.01) |
| *G08B 5/38* | (2006.01) |

(52) U.S. Cl.

CPC ..... *G08B 21/084* (2013.01); *G08B 21/043* (2013.01); *G08B 29/181* (2013.01); *G08B 5/38* (2013.01)

(58) Field of Classification Search

CPC .. G08B 21/084; G08B 21/043; G08B 29/181; G08B 5/38

See application file for complete search history.

(56) References Cited

U.S. PATENT DOCUMENTS

| | | | | |
|---|---|---|---|---|
| 5,463,598 | A * | 10/1995 | Holland | B63C 9/0005 367/118 |
| 6,222,484 | B1 * | 4/2001 | Seiple | B63C 9/0005 342/357.55 |
| 8,998,666 | B1 * | 4/2015 | Albright | B63C 9/00 340/539.13 |
| 2010/0328106 | A1 * | 12/2010 | Marshall | B63C 9/0005 340/984 |
| 2013/0171956 | A1 * | 7/2013 | Lever | G08B 21/088 455/404.1 |
| 2013/0214942 | A1 * | 8/2013 | Joss | G08B 21/088 340/984 |

FOREIGN PATENT DOCUMENTS

JP S57-181147 U 11/1982

* cited by examiner

*Primary Examiner* — Erin M File
(74) *Attorney, Agent, or Firm* — Pearne & Gordon LLP

(57) ABSTRACT

A radio apparatus includes a Man-Overboard detection unit, a control unit and a distress key. The Man-Overboard detection unit outputs a Man-Overboard signal when the radio apparatus has fallen to a water surface or into water. The control unit generates a distress signal including a distress type. A distress key outputs a distress key manipulation signal to the control unit when the distress key is manipulated. When the control unit receives the Man-Overboard signal from the Man-Overboard detection unit, the control unit automatically sets a distress type of the distress signal to Man-Overboard.

14 Claims, 6 Drawing Sheets

RADIO APPARATUS

CROSS-REFERENCES TO RELATED APPLICATION(S)

This application is based on and claims priority from Japanese Patent Application No. 2016-128954 filed on Jun. 29, 2016, the entire contents of which are incorporated herein by reference.

BACKGROUND

1. Field of the Invention

The present invention relates to a radio apparatus capable of quickly sending a distress signal without requiring a user to select a distress type upon occurrence of Man-Overboard.

2. Description of Related Art

Radio apparatuses for ships having a digital selective calling (DSC) function are also provided with a function of sending a distress signal in an emergency that the ship or a person(s) is in distress and requires rescue. Such radio apparatuses are equipped with a distress key for sending the distress signal, independently of other switches.

The distress key is provided with a switch cover so that a distress signal is not sent by an inadvertent manipulation thereof, and the distress key itself or the switch cover is colored in red. Such radio apparatuses are configured in such a manner that the distress signal is not sent unless the distress key is manipulated continuously for three seconds. That is, the distress signal is sent only when a series of manipulations is made that the switch cover is opened and then the distress key is manipulated continuously for three seconds.

The distress signal includes MMSI (maritime mobile service identity) which is an ID code of the self station and is a 9-digit numeral, information indicating a position of the self station, time information, and a distress type. There are eleven distress types, that is, fire/explosion ("explosion"), "flooding", "collision", "grounding", "capsizing", "sinking", incapability of steering the ship/adrift ("adrift"), "piracy", abandoning of the ship ("abandoning"), Man-Overboard ("MOB"), and "undesignated distress". A distress type is selected by manipulating a key switch(es).

The function of sending such a distress signal may be provided not only in radio apparatuses for ships but also in certain radio apparatuses for use on land.

JP-UM-A-57-181147 discloses a radio apparatus that sends such a distress signal.

The radio apparatus disclosed in JP-UM-A-57-181147 is equipped with plural key switches that are assigned the respective distress types in advance. The key switch corresponding to the type of an actual distress event is selected and manipulated. Thus, in the radio apparatus disclosed in JP-UM-A-57-181147, in the event of fallen into water, it is necessary to manipulate the key switch that is assigned "Man-Overboard".

In conventional radio apparatuses that are not equipped with such plural key switches, it is necessary to select a distress type manually by manipulating key switches in prescribed order, before sending the distress signal.

Even in a state that a radio apparatus is powered on, it is very difficult for a person who has fallen into water with the radio apparatus to select "Man-Overboard" from among the plural distress types by manipulating key switches and then manipulating the distress key.

In a state that a radio apparatus is powered off, it is even more difficult for a person who has fallen into water with the radio apparatus to manipulate the power key, then select "Man-Overboard" from among the plural distress types by manipulating key switches, and finally manipulating the distress key, than in a state that the radio apparatus is powered on.

SUMMARY

According to embodiments, when a user of a radio apparatus has fallen into water, the radio apparatus can send a distress signal indicating that a distress type is "Man-Overboard" merely by manipulating the distress key without selecting a distress type.

According to embodiments, a radio apparatus includes a Man-Overboard detection unit, a control unit and a distress key. The Man-Overboard detection unit outputs a Man-Overboard signal when the radio apparatus has fallen to a water surface or into water. The control unit generates a distress signal including a distress type. A distress key outputs a distress key manipulation signal to the control unit when the distress key is manipulated. When the control unit receives the Man-Overboard signal from the Man-Overboard detection unit, the control unit automatically sets a distress type of the distress signal to Man-Overboard.

According to embodiments, if the Man-Overboard detection unit detects that the radio apparatus has fallen to a water surface or into water, a distress signal is generated in which the distress type is automatically set to "Man-Overboard", so that the distress signal is quickly sent.

Other aspects and advantages of the invention will be apparent from the following description and the appended claims.

BRIEF DESCRIPTION OF THE DRAWINGS

FIG. 3 is a general flowchart illustrating a first half of a process that is executed by the radio apparatus according to the embodiment while it is powered on.

FIG. 4 is a general flowchart illustrating a second half of the process that is executed by the radio apparatus according to the embodiment while it is powered on.

DETAILED DESCRIPTION

Figure 1:
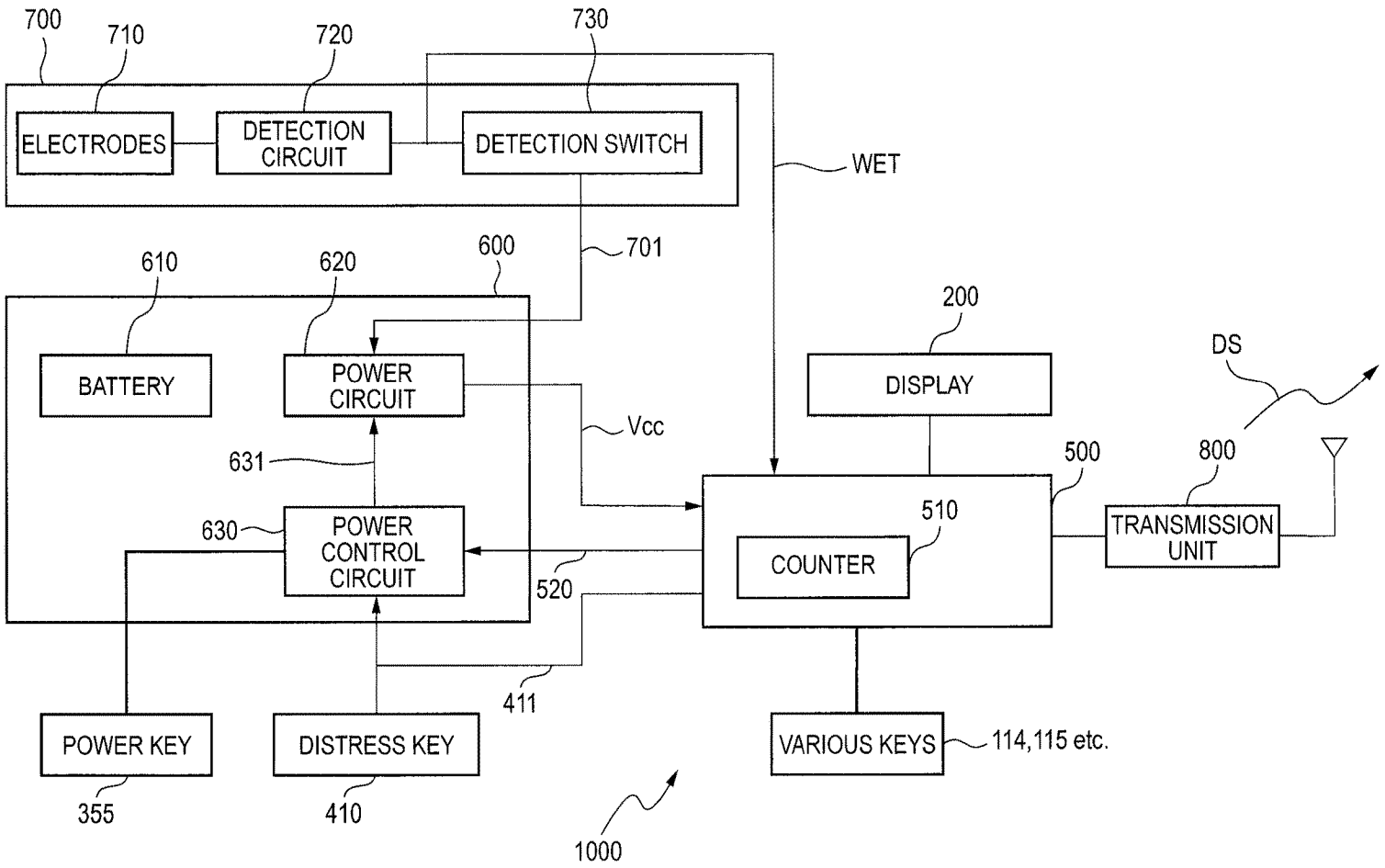
FIG. 1 is a general block diagram of a radio apparatus according to an embodiment.

In this description, a condition in which something or someone has fallen to a water surface or into water is referred as "Man-Overboard". A radio apparatus 1000 according to an exemplary embodiment is a radio apparatus having a function of sending a distress signal DS, and is equipped with a Man-Overboard detection unit 700 for outputting a Man-Overboard signal WET when detecting that the radio apparatus 1000 itself has fallen to a water surface or into water, a control unit 500 for generating a distress signal DS including at least a distress type together with identification information and position information of the self station, and a distress key 410 for outputting a distress key manipulation signal 411 to the control unit 500 when manipulated. When receiving the Man-Overboard signal WET from the Man-Overboard detection unit 700, the control unit 500 generates a distress signal DS in which the distress type is automatically set to "Man-Overboard".

The radio apparatus 1000 performs a radio communication in a marine VHF band. A typical example of the radio apparatus 1000 is a handy radio apparatus for ships that has a digital selective calling (DSC) function. This kind of radio apparatus 1000 for ships has a function of sending a distress signal DS when the ship or a person(s) is in distress and requires rescue. The radio apparatus 1000 sends a distress signal DS when the distress key 410 is manipulated which is provided independently of the other switches.

It is necessary that the distress signal DS include MMSI which is an ID code of the self station, information indicating a position of the self station, time information, and a distress type. There are eleven distress types, that is, fire/explosion ("explosion"), "flooding", "collision", "grounding", "capsizing", "sinking", incapability of steering the ship/adrift ("adrift"), "piracy", abandoning of the ship ("abandoning"), Man-Overboard ("MOB"), and "undesignated distress". Usually, a distress type may be selected by displaying a menu picture on a display 200 and manipulating prescribed key switches.

The radio apparatus 1000 has an appearance that an antenna 120 is installed on the top surface of a body 110. Because of employment, as a power source, of a lithium-ion battery which is light and of a large capacity and other reasons, the radio apparatus 1000 is light as a whole. With an additional feature that the case 111 is water-proof, the radio apparatus 1000 does not sink, that is, is kept afloat, even if it falls into water. In this specification, for the sake of convenience, falling to a water surface or into water is referred to as "Man-Overboard".

The radio apparatus 1000 is configured in such a manner that when the radio apparatus 1000 has fallen to a water surface or into water, a light-emitting element such as an LED blinks and, at the same time, a Man-Overboard alarm sound is emitted to inform the user of the fact that it has fallen to a water surface or into water as well as its current position.

The radio apparatus 1000 is configured in such a manner that when the radio apparatus 1000 is picked up from water, the blinking of the light-emitting element and the emission of the Man-Overboard alarm sound are stopped and a drainage sound is emitted to remove water from a speaker grille 112.

Figure 2A:
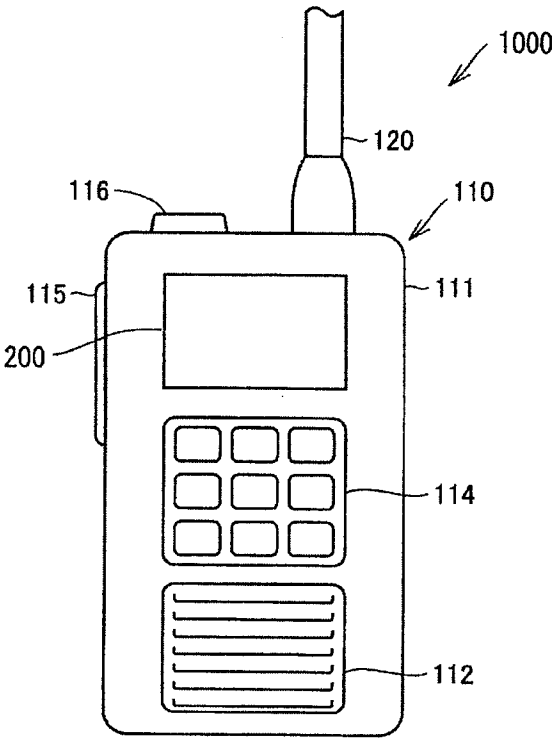
FIG. 2A is a schematic front view of the radio apparatus.
Figure 2B:
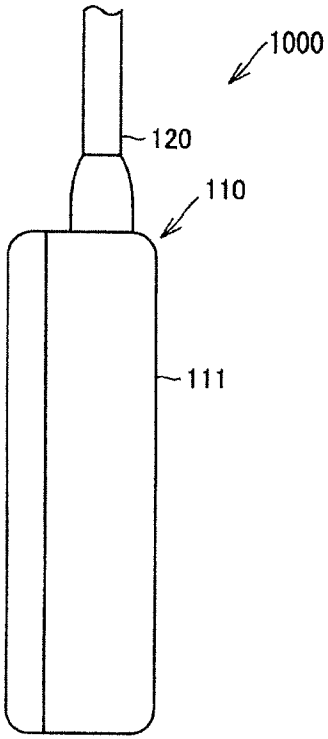
FIG. 2B is a schematic side view of the radio apparatus.
Figure 2C:
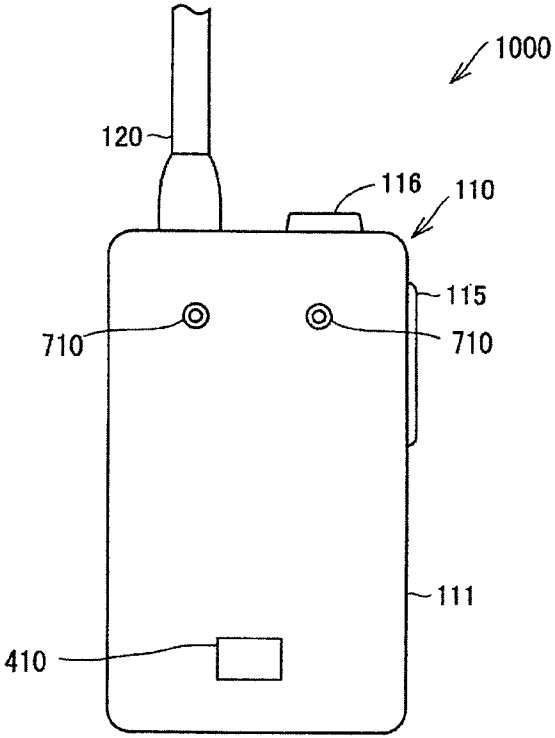
FIG. 2C is a schematic rear view of the radio apparatus.

The appearance of the radio apparatus 1000 according to the exemplary embodiment will be described in detail with reference to FIGS. 2A to 2C.

As described above, as for the appearance, the radio apparatus 1000 has the body 110 including a case 111 and the antenna 120 which projects upward from the top surface of the case 111. The antenna 120 is a rod-shaped antenna in which a coil-shaped antenna wire is housed in a resin pipe. Since the antenna wire is heavy because it is a copper or ion wire, the weight balance of the radio apparatus 1000 may be such that the center of gravity is deviated upward.

The display 200, a key panel 114, and the speaker grille 112 are arranged in this order from above on the front surface of the case 111.

A speaker SP is installed inside the speaker grille 112. A PTT (push-to-talk) switch 115 is disposed on the left side surface (when viewed from the front side) of the case 111. An SP/MIC connector 116 covered with a water-proof cap is disposed on the top surface of the case 111 on the left of the antenna 120 (when viewed from the front side).

The display 200 is a liquid crystal display and an LED(s) is disposed on the back side as a backlight. Various setting items such as a communication channel and a sound volume are displayed on the display 200.

Plural key switches including a power key 355 (see FIG. 1) and ten keys are arranged in the key panel 114. The power key 355 is a key switch for turning on/off the power. If the power key 355 is pushed for a prescribed time (e.g., 2 sec) or longer in a state that the radio apparatus 1000 is powered off, a power supply signal 631 is output from a power control circuit 630 to a power circuit 620. Upon receiving the power supply signal 631, the power circuit 620 starts to supply a voltage Vcc of a battery 610 continuously to individual units of the radio apparatus 1000.

If the power key 355 is pushed for a prescribed time (e.g., 2 sec) or longer in a state that the radio apparatus 1000 is powered on, the supply of the voltage Vcc from the battery 610 to the individual units of the radio apparatus 1000 is stopped.

An LED(s) as a backlight is disposed in the rear of the key panel 114. The key top of each of the key switches of the key panel 114 is made of such a material and has such a color as to transmit light, and is illuminated from the back side when the backlight is lit.

A pair of electrodes 710 which are disposed on the back surface of the case 111 at top-left and top-right positions are part of the Man-Overboard detection unit 700. When the radio apparatus 1000 falls to a water surface into water, the pair of electrodes 710 are short-circuited by water, that is, electric continuity is established between them. The control unit 500 of the radio apparatus 1000 detects that the radio apparatus 1000 has fallen to the water surface or into water based on short-circuiting between the pair of electrodes 710.

The installation positions of the pair of electrodes 710 are not limited to the above-mentioned positions; they may be disposed at any positions as long as they are short-circuited by water reliably when the radio apparatus 1000 falls into water.

The back surface of the case 111 is also provided with the distress key 410. The distress key 410 is an auto-recovery push switch which is kept on only while it is being pushed. It goes without saying that the distress key 410 may be disposed on a surface of the case 111 other than the back surface, such as its front surface or side surface.

The radio apparatus 1000 may be equipped with, in addition to the LEDs as the backlights, a light-emitting element such as an LED that blinks when the radio apparatus 1000 falls into water.

The Man-Overboard detection unit 700 is equipped with a detection circuit 720 and a detection switch 730 in addition to the above-described pair of electrodes 710. The detection circuit 720 detects whether or not the pair of electrodes 710 are short-circuited by water. If detecting a short circuit, the detection circuit 720 sends a Man-Overboard signal WET to the control unit 500 and the detection switch 730. When receiving the Man-Overboard signal WET, the detection switch 730 outputs a Man-Overboard power supply signal 701 to a power circuit 620 of a power unit 600.

The power unit 600 of the radio apparatus 1000 is equipped with the battery 610, the power circuit 620, and a power control circuit 630. The power circuit 620 supplies the voltage Vcc of the battery 610 to the individual units of the radio apparatus 1000. In response to a manipulation on the power key 355 or the distress key 410, the power control circuit 630 controls the power circuit 620 so that it supplies the voltage Vcc of the battery 610 to the individual units of the radio apparatus 1000.

The control unit 500 of the radio apparatus 1000 is a microcontroller which is equipped with a CPU, memories, various interfaces, an A/D converter, a D/A converter, etc. The control unit 500 of the radio apparatus 1000 controls the whole of operations of the radio apparatus 1000. The control unit 500 is equipped with a counter 510 for measuring, by counting, a time during which the distress key 410 is manipulated continuously, that is, a distress key manipulation signal 411 continues to be input to the control unit 500.

Next, referring to FIGS. 3 and 4, a more detailed description will be made of how the radio apparatus 1000 according to the exemplary embodiment operates while it is powered on.

Figure 3:
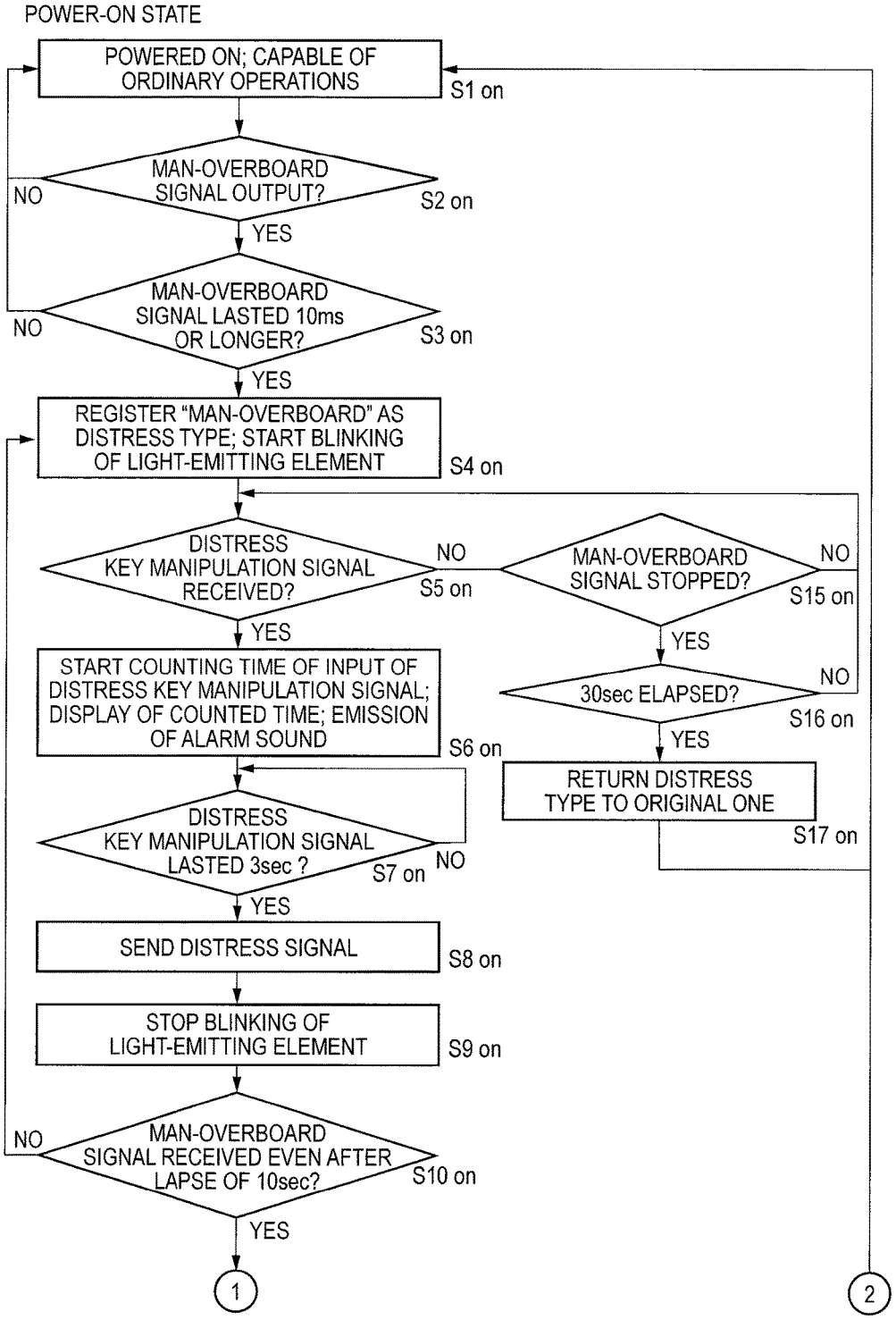
Figure 4:
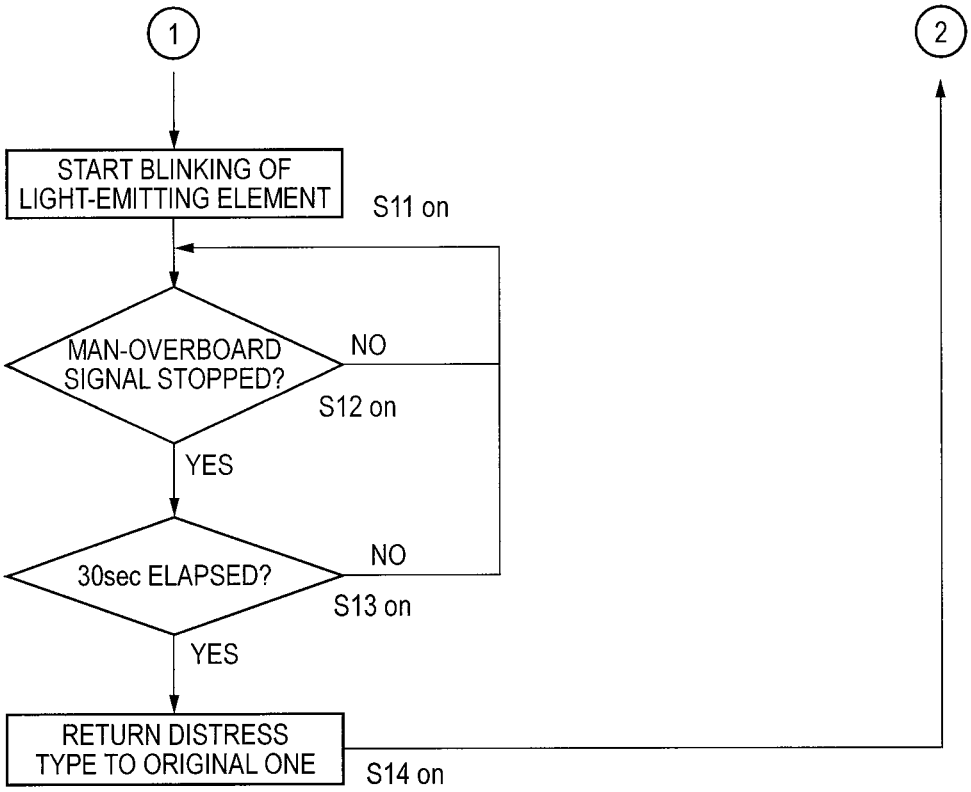

While being powered on, the radio apparatus 1000 is in an ordinary operation state, that is, a state that, for example, it can perform an ordinary communication and receive a manipulation (step S1on; see FIG. 3). While the radio apparatus 1000 is in this state, the control unit 500 does not generate a distress signal DS. However, an initial distress type "undesignated distress" is selected in advance as a distress type to be included in a distress signal DS.

If the radio apparatus 1000 being in this state falls into water, the pair of electrodes 710 which are disposed on the back surface the case 111 at the top-left and top-right positions are short-circuited by water and the detection circuit 720 of the Man-Overboard detection unit 700 outputs, to the control unit 500, a Man-Overboard signal WET indicating the occurrence of Man-Overboard (S2on: yes).

If the Man-Overboard signal WET has continued to be input to the control unit 500 for a prescribed time (e.g., 10 ms) or longer (S3on: yes), at step S4on the control unit 500 selects the distress type "Man-Overboard" and automatically registers it as a distress type to be included in a distress signal DS. At the same time, the control unit 500 acquires other pieces of information to be included in a distress signal DS, that is, MMSI which is an ID code of the self station, information indicating a position of the self station, and time information, from a storage unit (not shown) etc. and generates a distress signal DS incorporating the above pieces of information.

At step S4on, at the same time as it generates the distress signal DS, the control unit 500 starts blinking of the light-emitting element such as an LED which is provided in the radio apparatus 1000 and emission of a Man-Overboard alarm sound. The blinking of the light-emitting element and the emission of a Man-Overboard alarm sound are to notify nearby persons of the fact that the radio apparatus 1000 has fallen to the water surface or into water and its current position.

The reason why the control unit 500 selects "Man-Overboard" only if it has continued to receive a Man-Overboard signal WET for 10 ms or longer is to prevent the control unit 500 from erroneously judging as Man-Overboard, a state that the pair of electrodes 710 are short-circuited instantaneously because of mere water splashing thereon.

If the input of the Man-Overboard signal WET is finished without lasting 10 ms or longer (S3on: no), the control unit 500 causes the radio apparatus 1000 to return to the ordinary operation state. That is, if the output of the Man-Overboard signal WET is not a result of Man-Overboard but a result of another event such as mere water splashing on the radio apparatus 1000, the control unit 500 neither selects the distress type "Man-Overboard" nor generates a distress signal DS automatically.

If the distress key 410 is manipulated and a distress key manipulation signal 411 is input to the control unit 500 in the state that the Man-Overboard signal WET has continued to be input to the control unit 500 for 10 ms or longer and the distress signal DS has been generated (S5on: yes), at step S6on the control unit 500 starts operation of the counter 510. The counter 510 measures, by counting, a time during which the control unit 500 continues to receive the distress key manipulation signal 411.

At the same as it starts the counting operation of the counter 510, the control unit 500 causes the display 200 to display a time of continuation of the input of the distress key manipulation signal 411 and starts emission of an alarm sound indicating that the distress key 410 has been manipulated. It is desirable that this alarm sound be distinguishable from the Man-Overboard alarm sound which is emitted at the occurrence of Man-Overboard.

If the control unit 500 has continued to receive the distress key manipulation signal 411 for a preset time (e.g., 3 sec) (S7on: yes), at step S8on the control unit 500 causes a transmission unit 800 to send the distress signal DS. The distress signal DS is a signal including MMSI which is the ID code of the self station, information indicating a position of the self station, time information, and the distress type "Man-Overboard".

At step S9on, the control unit 500 stops blinking the light-emitting element. Since the fact that the distress key 410 has been manipulated and the distress signal DS has been sent means that the user who has fallen into water holds the radio apparatus 1000 and has done what is necessary for sending of the distress signal DS (i.e., has manipulated the distress key 410), the control unit 500 stops blinking the light-emitting element to prevent subsequent useless power consumption.

However, if the Man-Overboard signal WET is being input to control unit 500 (S loon: yes) even after a lapse of a prescribed time (e.g., 10 sec) from the stop of blinking of the light-emitting element at step S9on, at step S11on (see FIG. 4) the control unit 500 restarts blinking the light-emitting element. This is to make it easier for persons on board to find the radio apparatus 1000 still being in the Man-Overboard state though its distress key 410 was manipulated, that is, the person who is fallen into water.

If the input of the Man-Overboard signal WET to the control unit 500 is stopped (S12on: yes) after the restart of blinking of the light-emitting element and this state has lasted 30 sec (S13on: yes), the control unit 500 returns the distress type from "Man-Overboard" to the initial one "undesignated distress" at step S14on. Then the control unit 500 causes the radio apparatus 1000 to return to the state that it assumed before the output of the Man-Overboard signal WET, that is, the process returns to step S1on.

If no distress key manipulation signal 411 is input to the control unit 500 at step S5on (see FIG. 3), the input of the Man-Overboard signal WET to the control unit 500 is then stopped (S15on: yes), and this state has lasted a prescribed time (e.g., 30 sec) (S16on: yes), the control unit 500 returns the distress type from "Man-Overboard" to the initial one "undesignated distress" at step S17on. The control unit 500 causes the radio apparatus 1000 to return to the state that it assumed before the output of the Man-Overboard signal WET, that is, the process returns to step S1on.

This is because it is judged that the radio apparatus 1000 has been taken out of the water, that is, the person fallen into water and the radio apparatus 1000 have gotten out of the Man-Overboard state, before sending of the distress signal DS; that is, it is no longer necessary to send the distress signal DS.

The radio apparatus 1000 is configured so as to emit a draining sound after recovery from the Man-Overboard state to secure a smooth call by removing water from the speaker grille 112.

Next, referring to FIGS. 5 and 6, a more detailed description will be made of how the radio apparatus 1000 according to the exemplary embodiment operates starting from a state that it is powered off.

Figure 5:
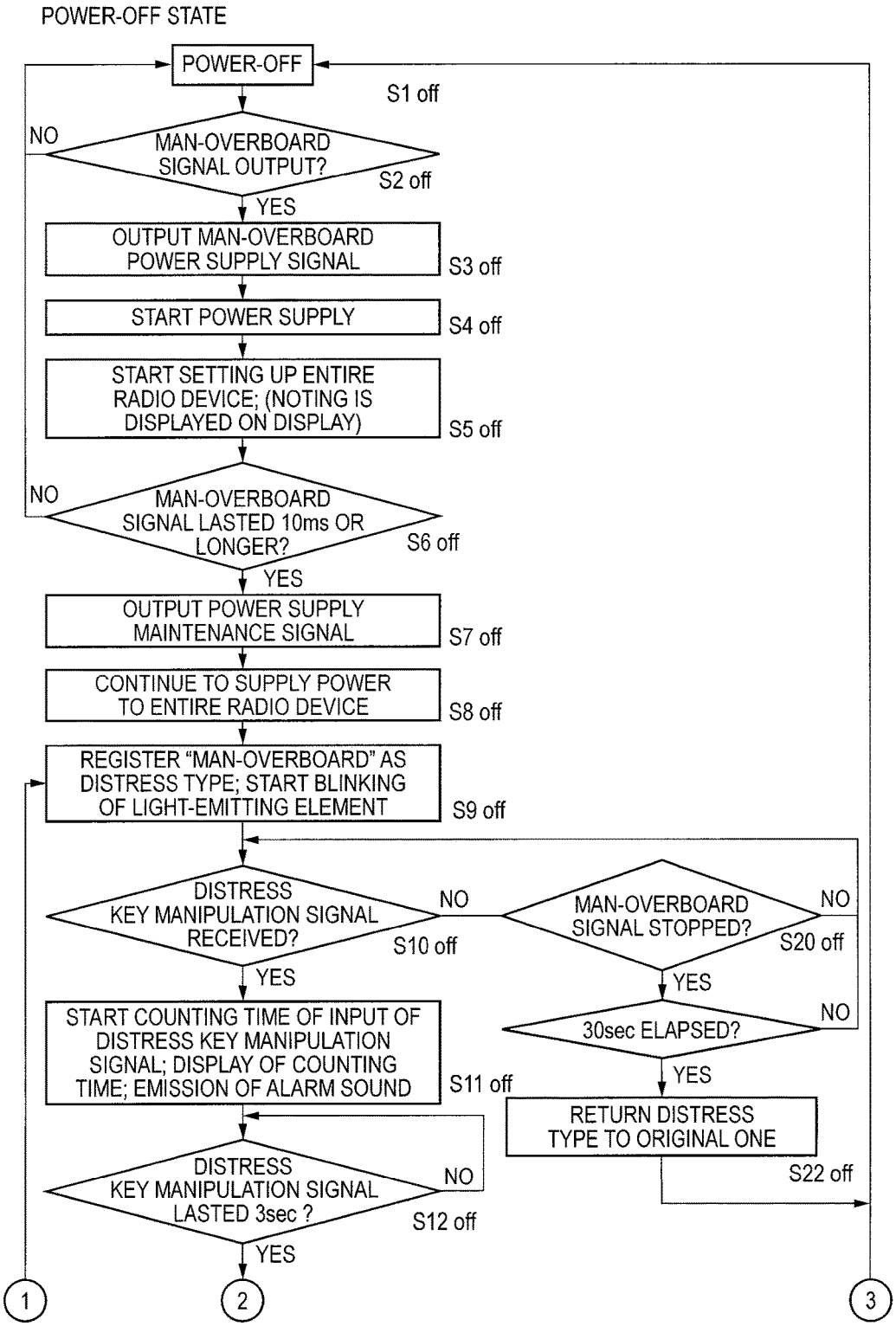
FIG. 5 is a general flowchart illustrating a first half of a process that is executed by the radio apparatus according to the embodiment starting from a state that it is powered off.
Figure 6:
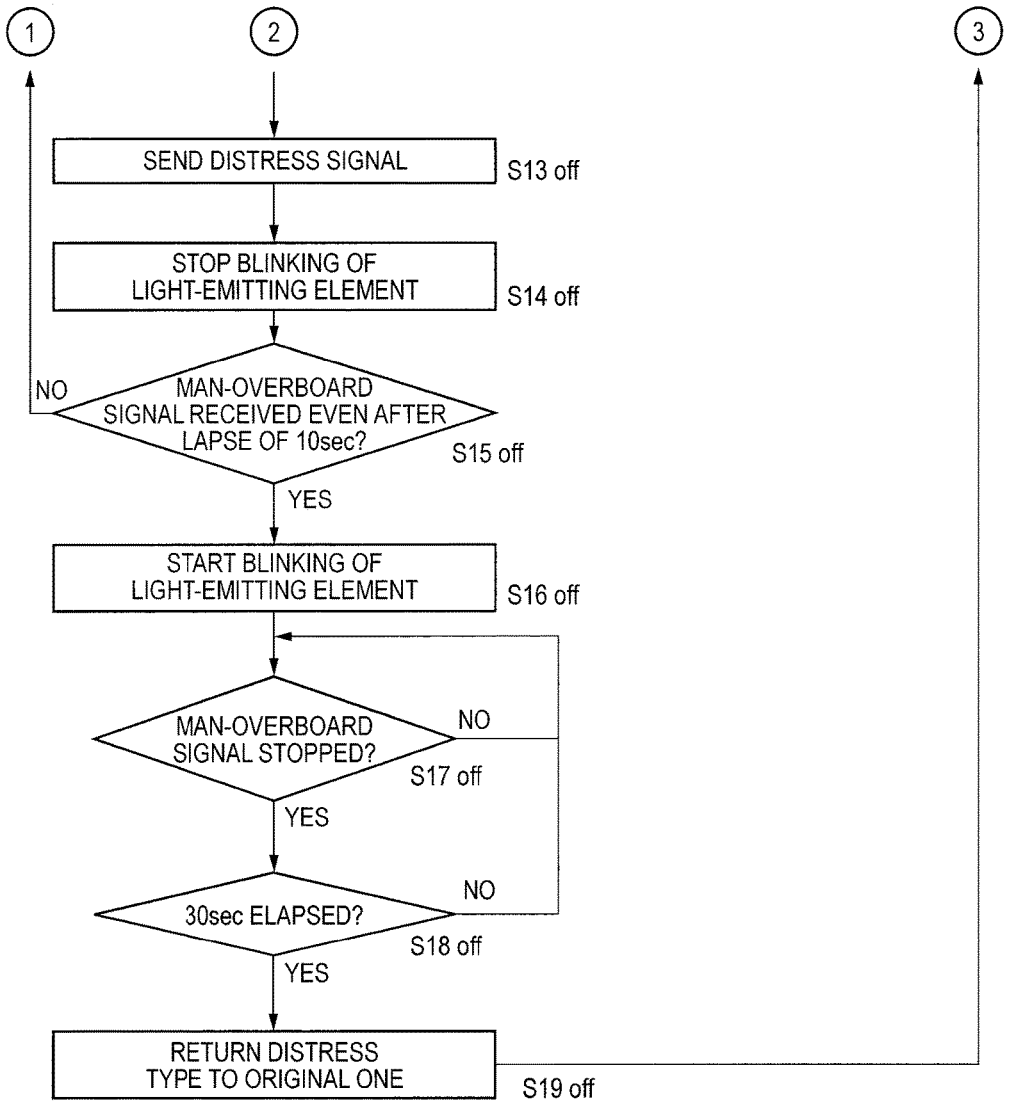
FIG. 6 is a general flowchart illustrating a second half of the process that is executed by the radio apparatus according to the embodiment starting from a state that it is powered off.

While being powered off, the radio apparatus 1000 is incapable of performing ordinary operations, that is, it is in a state that it cannot perform, for example, an ordinary communication or receive a manipulation (step S1off; see FIG. 5).

If the radio apparatus 1000 being in this state falls into water, the pair of electrodes 710 which are disposed on the back surface the case 111 at the top-left and top-right positions are short-circuited by water and the detection circuit 720 of the Man-Overboard detection unit 700 outputs, to the control unit 500 and the detection switch 730, a Man-Overboard signal WET indicating the occurrence of Man-Overboard (S2off: yes).

Receiving the Man-Overboard signal WET from the detection circuit 720, at step S3off the detection switch 730 of the Man-Overboard detection unit 700 outputs a Man-Overboard power supply signal 701 to the power circuit 620 of the power unit 600.

Receiving the Man-Overboard power supply signal 701, at step S4off the power circuit 620 starts supplying the voltage Vcc of the battery 610 to the control unit 500 and other units of the radio apparatus 1000. At step S5off, the control unit 500 which has received the Man-Overboard signal WET and is supplied with the voltage Vcc starts setting-up the entire radio apparatus 1000.

At this time point, although the voltage Vcc is supplied to the units including the control unit 500 that are necessary for setting-up of the radio apparatus 1000, it is not supplied to the units that are not necessary for the setting-up of the radio apparatus 1000, such as the display 200. Thus, at this time point (step S5off), nothing is displayed on the display 200.

This supply of the voltage Vcc is temporary; that is, the supply of the voltage Vcc is stopped as soon as the output of the Man-Overboard signal WET from the detection circuit 720 and the input of the Man-Overboard power supply signal 701 to the power circuit 620 are stopped.

At the same time as it starts setting up the radio apparatus 1000, the control unit 500 starts blinking of the light-emitting element and emission of a Man-Overboard alarm sound to notify nearby persons of the fact that the radio apparatus 1000 has fallen to a water surface or into water as well as its current position.

If the Man-Overboard signal WET has continued to be input to the control unit 500 for a preset time (e.g., 10 ms) or longer (S6off: yes), at step S7off the control unit 500 outputs a power supply maintenance signal 520 to the power control circuit 630. Receiving the power supply maintenance signal 520, at step S8off the power control circuit 630 controls the power circuit 620 so that it continues to supply the voltage Vcc of the battery 610 to the entire radio apparatus 1000, that is, the control unit 500 and the other units of the radio apparatus 1000.

At step S9off, the control unit 500 selects the distress type "Man-Overboard" and automatically registers it as a distress type to be included in a distress signal DS. At the same time, the control unit 500 acquires other pieces of information to be included in a distress signal DS, that is, MMSI which is the ID code of the self station, information indicating a position of the self station, and time information, from a storage unit (not shown) etc. and generates a distress signal DS incorporating the above pieces of information.

At step S9off, at the same time as it generates the distress signal DS, the control unit 500 starts blinking of the light-emitting element such as an LED which is provided in the radio apparatus 1000 and emission of a Man-Overboard alarm sound. The blinking of the light-emitting element and the emission of a Man-Overboard alarm sound are to notify nearby persons of the fact that the radio apparatus 1000 has fallen to a water surface or into water and its current position.

The reason why the control unit 500 selects "Man-Overboard" only if it has continued to receive a Man-Overboard signal WET for 10 ms or longer is to prevent the control unit 500 from erroneously judging as Man-Overboard, a state that the pair of electrodes 710 are short-circuited instantaneously because of mere water splashing thereon.

If the input of the Man-Overboard signal WET is finished without lasting 10 ms or longer (S6off: no), the control unit 500 causes the radio apparatus 1000 to return to the off state. That is, if the output of the Man-Overboard signal WET is not a result of Man-Overboard but a result of another event such as mere water splashing on the radio apparatus 1000, the control unit 500 causes the radio apparatus 1000 to return to the off state and hence neither selects the distress type "Man-Overboard" nor generates a distress signal DS automatically.

If the distress key 410 is manipulated and a distress key manipulation signal 411 is input to the control unit 500 in the state that the Man-Overboard signal WET has continued to be input to the control unit 500 for 10 ms or longer and the distress signal DS has been generated (S10off: yes), at step S11off the control unit 500 starts operation of the counter 510. The counter 510 measures, by counting, a time during which the control unit 500 continues to receive the distress key manipulation signal 411.

At the same as it starts the counting operation of the counter 510, the control unit 500 causes the display 200 to display a time of continuation of the input of the distress key manipulation signal 411 and starts emission of an alarm sound indicating that the distress key 410 has been manipulated. It is desirable that this alarm sound be distinguishable from the Man-Overboard alarm sound which is emitted at the occurrence of Man-Overboard.

If the control unit 500 has continued to receive the distress key manipulation signal 411 for a preset time (e.g., 3 sec) (S12off: yes), at step S13off (see FIG. 6) the control unit 500 causes the transmission unit 800 to send the distress signal DS. The distress signal DS is a signal including MMSI which is the ID code of the self station, information indicating a position of the self station, time information, and the distress type "Man-Overboard".

At step S14off, the control unit 500 stops blinking the light-emitting element. Since the fact that the distress key 410 has been manipulated and the distress signal DS has been sent means that the person who has fallen into water holds the radio apparatus 1000, the control unit 500 stops blinking the light-emitting element to prevent subsequent useless power consumption.

However, if the Man-Overboard signal WET is being input to control unit 500 (S15off: yes) even after a lapse of a prescribed time (e.g., 10 sec) from the stop of blinking of the light-emitting element which resulted from the manipulation of the distress key 410, at step S16off the control unit 500 restarts blinking the light-emitting element. This is to make it easier for persons on board to find the radio apparatus 1000 still being in the Man-Overboard state though its distress key 410 was manipulated, that is, the person who fallen into water.

If the input of the Man-Overboard signal WET to the control unit 500 is stopped (S17off: yes) after the restart of blinking of the light-emitting element and this state has lasted 30 sec (S18off: yes), the control unit 500 returns the distress type from "Man-Overboard" to the initial one "undesignated distress" at step S19off. Then the control unit 500 causes the radio apparatus 1000 to return to the state that it assumed before the output of the Man-Overboard signal WET, that is, the process returns to step S1off.

If no distress key manipulation signal 411 is input to the control unit 500 at step S10off (see FIG. 5), the input of the Man-Overboard signal WET to the control unit 500 is then stopped (S20off: yes), and this state has lasted a prescribed time (e.g., 30 sec) (S21off: yes), the control unit 500 returns the distress type from "Man-Overboard" to the initial one "undesignated distress" at step S22off. The control unit 500 causes the radio apparatus 1000 to return to the state that it assumed before the output of the Man-Overboard signal WET, that is, the process returns to step S1off.

This is because it is judged that the radio apparatus 1000 has been taken out of the water, that is, the person who fallen into water and the radio apparatus 1000 have gotten out of the Man-Overboard state, before sending of the distress signal DS; that is, it is no longer necessary to send the distress signal DS.

The radio apparatus 1000 is configured so as to emit a draining sound after recovery from a Man-Overboard state to secure a smooth call by removing water from the speaker grille 112.

In the above-described radio apparatus 1000 according to the exemplary embodiment, if it falls to a water surface or into water, blinking of the light-emitting element such as an LED and emission of a Man-Overboard alarm sound are started simultaneously. However, an alternative configuration is possible in which neither blinking of the light-emitting element nor emission of a Man-Overboard alarm sound is done.

In the above-described radio apparatus 1000 according to the exemplary embodiment, blinking of the light-emitting element such as an LED and emission of an alarm sound are started when the distress key 410 is manipulated. However, an alternative configuration is possible in which neither blinking of the light-emitting element nor emission of an alarm sound is done.

Although the above-described embodiment is directed to the handy radio apparatus 1000 for ships, the invention is not limited to this case. It goes without saying that the invention can also be applied to stationary radio apparatuses and radio apparatuses for use on land.

DESCRIPTION OF SYMBOLS

1000: Radio apparatus
410: Distress key
411: Distress key manipulation signal
500: Control unit
700: Man-Overboard detection unit
WET: Man-Overboard signal
DS: Distress signal

What is claimed is:

1. A radio apparatus comprising:

a detector configured to send a Man-Overboard signal in response to detecting that the radio apparatus has fallen to a water surface or into water;

a controller configured to automatically set a distress type to be Man-Overboard in response to receiving the Man-Overboard signal for a prescribed time or longer;

the controller configured to generate a distress signal including at least the distress type together with identification and position information of the radio apparatus in response to setting of the distress type to Man-Overboard; and a distress key configured to output a distress key manipulation signal in response to a manipulation of the distress key;

wherein the controller is configured to transmit the distress signal including the distress type Man-Overboard, in response to receiving the distress key manipulation signal continuously for a predetermined time or longer.

2. The radio apparatus according to claim 1, further comprising:

a power unit, wherein the detector is configured to output a Man-Overboard power supply signal to the power unit in addition to the Man-Overboard signal, in response to detecting that the radio apparatus has fallen to the water surface or into water, wherein the power unit is configured to supply power to the controller in response to receiving the Man-Overboard power supply signal in a state that the radio apparatus is powered off, and wherein the controller is configured to start setting up the radio apparatus in response to receiving the power from the power unit, and to generate the distress signal in which the distress type is automatically set to Man-Overboard in response to receiving the Man-Overboard signal from the detector.

3. The radio apparatus according to claim 2, wherein the controller is configured to output a power supply maintenance signal to the power unit in response to continuously receiving the Man-Overboard signal for a preset time or longer, and wherein the power unit is configured to maintain a supply of power to the controller in response to receiving the power supply maintenance signal.

4. The radio apparatus according to claim 3, further comprising:

a transmitter, wherein the controller is configured to cause the transmitter to send the distress signal whose distress type has been set to Man-Overboard, in response to continuously receiving the distress key manipulation signal for the predetermined time in a state that the distress signal has been generated.

5. The radio apparatus according to claim 2, further comprising:

a transmitter, wherein the controller is configured to cause the transmitter to send the distress signal whose distress type has been set to Man-Overboard, in response to continuously receiving the distress key manipulation signal for the predetermined time in a state that the distress signal has been generated.

6. The radio apparatus according to claim 1, further comprising:

a transmitter, wherein the controller is configured to cause the transmitter to send the distress signal whose distress type has been set to Man-Overboard, in response to continuously receiving the distress key manipulation signal for the predetermined time in a state that the distress signal has been generated.

7. The radio apparatus according to claim 1, further comprising:

operating keys configured to select a distress type of the distress signal among a plurality of distress types, wherein the controller is configured to automatically set the distress type of the distress signal to Man-Overboard in response to receiving the Man-Overboard signal.

8. A method of sending a distress signal in a radio apparatus, the method comprising:

sending a Man-Overboard signal in response to a detector detecting that the radio apparatus has fallen to a water surface or into water;

setting a distress type to be Man-Overboard in response to receiving the Man-Overboard signal for a prescribed time or longer;

generating a distress signal including at least the distress type together with identification and position information of the radio apparatus in response to setting of the distress type to Man-Overboard;

outputting a distress key manipulation signal when a distress key is manipulated; and transmitting the distress signal including the distress type Man-Overboard in response to receiving the distress key manipulation signal continuously for a predetermined time or longer.

9. The method according to claim 8, further comprising:

outputting a Man-Overboard power supply signal to a power unit in addition to the Man-Overboard signal, when the detector detects that the radio apparatus has fallen to the water surface or into water;

supplying power from the power unit to the controller when the power unit receives the Man-overboard power supply signal in a state that the radio apparatus is powered off; and starting setting-up the radio apparatus when the controller receives the power from the power unit, and generating the distress signal in which the distress type is automatically set to Man-Overboard when the controller receives the Man-Overboard signal from the detector.

10. The method according to claim 9, further comprising:

outputting a power supply maintenance signal from the controller to the power unit when the controller continuously receives the Man-Overboard signal for a preset time or longer; and maintaining a supply of power from the power unit to the controller when the power unit receives the power supply maintenance signal.

11. The method according to claim 9, further comprising:

sending the distress signal from a transmitter when the controller continuously receives the distress key manipulation signal for the predetermined time after the setting process and the setting process are conducted.

12. The method according to claim 8, further comprising:

sending the distress signal from a transmitter when the controller continuously receives the distress key manipulation signal for the predetermined time after the setting process and the setting process are conducted.

13. The method according to claim 8, further comprising:

sending the distress signal from a transmitter when the controller continuously receives the distress key manipulation signal for the predetermined time after the setting process and the setting process are conducted.

14. The method according to claim 8, further comprising:

selecting a distress type of the distress signal among a plurality of distress types using operating keys, wherein the setting process, the distress type of the distress signal is automatically set to Man-Overboard in response to the controller receiving the Man-Overboard signal.

* * * * *